United States Patent [19]

Pierce

[11] Patent Number: 4,879,978

[45] Date of Patent: Nov. 14, 1989

[54] POPPET VALVE SPRING RETAINER

[76] Inventor: Daniel H. Pierce, 1330 Lyonhurst Rd., Birmingham, Mich. 48009

[21] Appl. No.: 236,553

[22] Filed: Aug. 25, 1988

[51] Int. Cl.[4] ..... F01L 3/10

[52] U.S. Cl. ..... 123/90.67; 123/188 SB

[58] Field of Search ..... 123/90.67, 188 SB, 188 AA

[56] References Cited

U.S. PATENT DOCUMENTS

| | | | |
|---|---|---|---|
| 1,775,069 | 9/1930 | Finney | 123/90.67 |
| 1,930,894 | 10/1933 | Gorman | 123/90.67 |
| 3,273,856 | 9/1966 | Tauschek | 123/90.67 |
| 3,612,016 | 10/1971 | Jelen | 123/90.67 |

FOREIGN PATENT DOCUMENTS

| | | | |
|---|---|---|---|
| 217504 | 6/1924 | United Kingdom | 123/90.67 |

*Primary Examiner*—Charles J. Myhre
*Assistant Examiner*—Weilun Lo
*Attorney, Agent, or Firm*—Reising, Ethington, Barnard, Perry & Milton

[57] ABSTRACT

An engine (10) is provided including a poppet valve (14) for regulating the flow of gases to and from a combustion chamber (13). The poppet valve (14) includes an elongated stem (18). A return spring (20) is connected to the stem (18) and urges the poppet valve (14) perpendicularly toward a valve seat (16). A spring retainer (22) locks onto the stem (18) of the poppet valve (14) to retain the return spring on the poppet valve (14). A central bore (26) is provided in the spring retainer (22) and includes a radially inwardly extending ledge (30). Three equally spaced slots (32) are disposed through the spring retainer (22) for allowing the ledge (30) in the bore (26) to deflect outwardly while the spring retainer (22) is inserted onto the stem (18) of the poppet valve (14). When the spring retainer (22) is moved to an operational position on the stem (18), the ledge (30) snaps underneath a corresponding recessed surface (28) provided in the stem (18) for automatically locking the spring retainer (22) onto the stem (18) of the poppet valve (14).

21 Claims, 2 Drawing Sheets

POPPET VALVE SPRING RETAINER

TECHNICAL FIELD

The subject invention relates to an engine including a spring retainer for retaining a return spring on the stem of a poppet valve, and more specifically to a self-locking spring retainer.

BACKGROUND ART

Valve spring retainers are well known in the engine art to interconnect a poppet valve and a return spring. The prior art valve spring retainers are composed of multiple metal pieces. A special tool is required to install the prior art spring retainers onto the stem of the poppet valve This installation procedure is a difficult and cumbersome task. On the assembly line, where time is a valuable commodity, the installation of prior art spring retainers can become a costly procedure.

The prior art spring retainers, therefore, are expensive to fabricate, due to the many metal pieces, and also expensive to install, due to the time required to operate the cumbersome tools which lock the spring retainer upon the stem of the poppet valve. Additionally, the tools required to install prior art valve spring retainers are, in themselves, expensive. Further, the prior art valve spring retainers are heavy due to their metallic construction, and thus add considerably to the weight of the reciprocating valve train.

SUMMARY OF THE INVENTION AND ADVANTAGES

An engine apparatus is provided including a spring retainer of the type for retaining a return spring on a stem of a poppet valve. The apparatus comprises a valve seat, a valve guide, a poppet valve having a stem slideably supported in the valve guide, a return spring associated with the poppet valve for urging the poppet valve in a predetermined direction against the valve seat, and retainer means having an operational position on the stem for retaining the return spring on the poppet valve. The apparatus is characterized by the return means including self-locking means for automatically locking the retainer means on the stem when the retainer means is in the operational position.

The self-locking means of the subject invention allows the subject spring retainer means to be easily and quickly installed by inserting the stem into the retainer means. Special tools are not required to lock the retainer means onto the poppet valve stem as the self-locking means automatically locks the retainer means onto the valve stem. Additionally, the subject retainer means can be fabricated from light weight non-metallic materials thus reducing the overall weight of the engine. Further, the subject retainer means can be entirely fabricated in a single unitary piece so that many separate pieces are not required.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
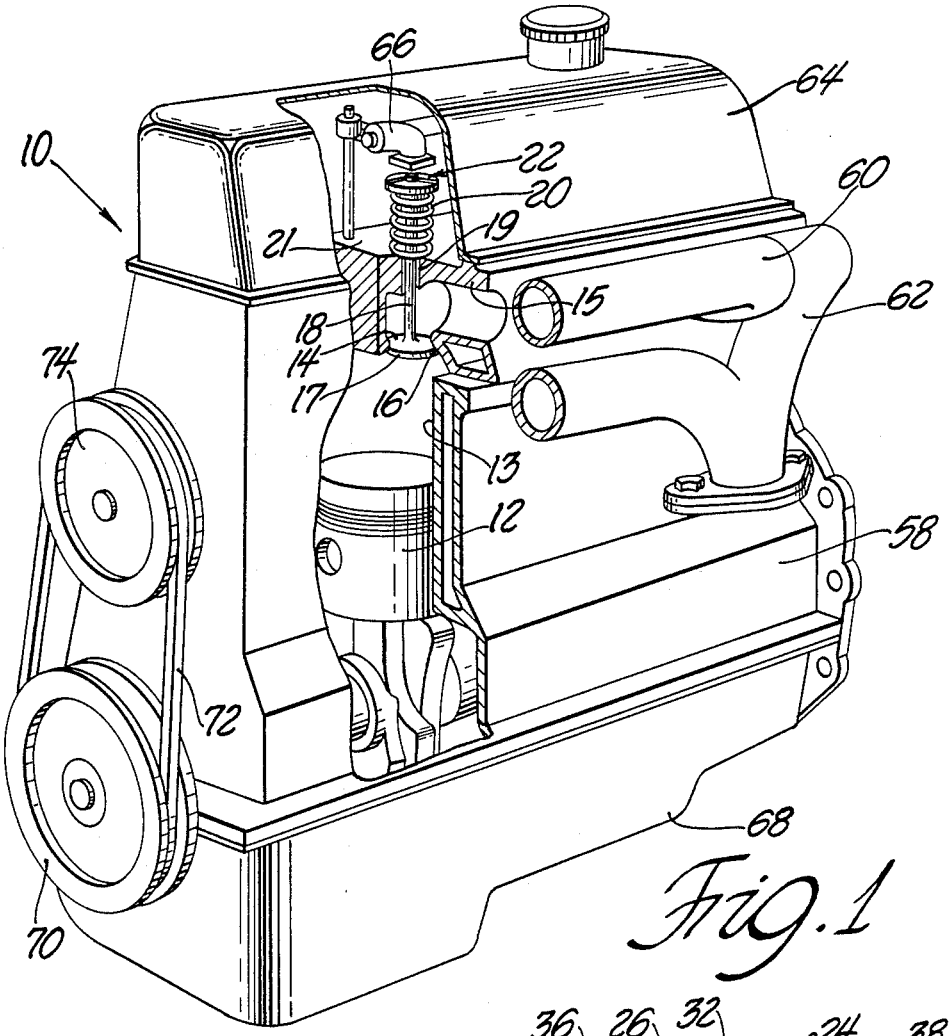
FIG. 1 is a perspective view of an internal combustion engine according to the subject invention partially cut away showing a poppet valve, return spring and spring retainer means of the subject invention.

An internal combustion engine according to the subject invention is generally shown at 10 in FIG. 1. The engine 10 includes at least one reciprocating piston 12 disposed in a combustion chamber 13 for intaking fresh and exhausting burnt fuel via a network of poppet valves 14. A poppet valve 14 is slideably supported in a cylinder head 15 and shown disposed in a seated position in a valve seat 16. The poppet valve 14 includes a valve head 17 adapted to seal against the valve seat 16 and an elongated cylindrical stem 18 extending perpendicularly from the valve head 17 and slideably supported in a valve guide 19 for perpendicular movement toward and away from the seating position at the valve seat 16. The stem guide 19 is fixedly disposed in a portion of the cylinder head 15 in a manner well known in the art.

A return spring 20 of the helical wound compression type surrounds an upper portion of the stem 18 above the stem guide 19 for urging the poppet valve 14 in a predetermined direction toward the seating position. The bottom end of the return spring 20 rests against a support portion 21 of the cylinder head !5 adjacent the valve guide 19, and an upper portion of the return spring 20 engages a retainer means, generally indicated at 22, for transferring forces to the poppet valve 14. That is, the retainer means 22 is fixedly disposed on, or attached to, the end of the stem 18 distall the valve head 17 for retaining the return spring 20 on the poppet valve 14. Thus, the retainer means 22 moves with the poppet valve 14 and functions to interconnect the stem 18 of the poppet valve 14 and the return spring 20.

Figure 3:
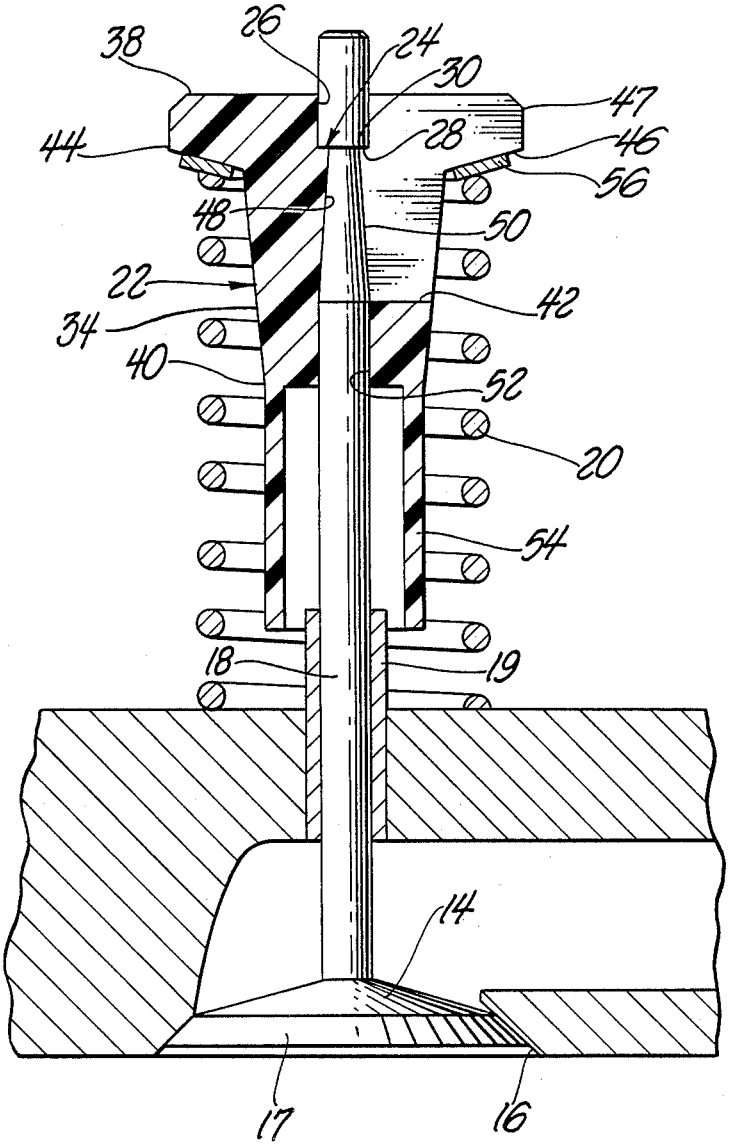
FIG. 3 is a cross-sectional view of an alternative embodiment of the subject spring retainer means disposed in an operational position on a poppet valve stem.

The retainer means 22 has an operational position on the stem 18, shown in FIGS. 1 and 3, wherein the retainer means 22 is adapted to retain the return spring 20 upon the stem 18 and transfer forces therebetween. That is to say, the operational position is a predetermined relative position between the retainer mean 22 and the stem 18 in which the return spring 20 is retained on the poppet valve 14 ready for operation in the engine 10.

Figure 2:
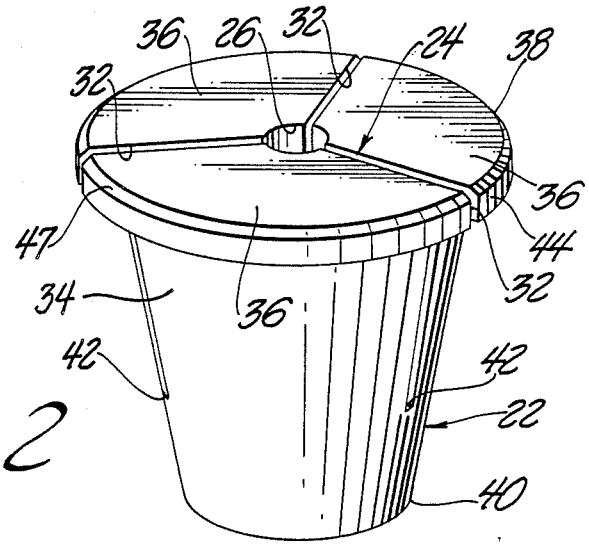
FIG. 2 is a perspective view of the spring retainer means of the subject invention.

The retainer means 22 is characterized by including self-locking means, generally indicated at 24 in FIGS. 2 and 3, for automatically locking the retainer means 22 on the stem 18 when the retainer means 22 is moved on the stem 18 to the operational position. The self-locking means 24, in other words, automatically locks the retainer means 22 onto the stem 18 of the poppet valve 14 by merely moving the retainer means 22 into the operational position and thereby alleviates the requirement of special tools adapted to perform this function. As best shown in FIG. 3, the self-locking means 24 is integral with the retainer means 22 and extends inwardly from a central cylindrical bore 26 in the retainer means 22. That is, the self-locking means 24 is an integral portion of the retainer means 22 and has a smaller diameter then either the bore 26 or the stem 18 for automatically locking onto the stem 18 when in the operational position.

As shown in FIG. 3, the stem 18 includes a recessed surface 28 facing in a direction away from the predetermined direction, i.e., the direction in which the return spring 20 urges the poppet valve 14. In other words, the recessed surface 28 of the stem 18 is presented toward the valve head 17 and the valve seat 16. Similarly, the self-locking means 24 includes a ledge 30 extending radially inwardly from the bore 26 and facing in a direction toward the predetermined direction That is, the ledge 30 is presented in an opposite direction from the recessed surface 28 when the in the operational position. The recessed surface 28 of the stem 18 and the ledge 30 of the self-locking means 24 are both annular and disposed in plane perpendicular to the bore 26 and stem 18 when in the operational position. More particularly, the recessed surface 28 and the ledge 30 are contiguous when in the operational position for transferring forces between the retainer means 22 and the poppet valve 14. Thus, the recessed surface 28 and the ledge 30 abut and press against each other during operation in order that the return spring 20 may exert a force in the predetermined direction on the poppet valve 14 to return the poppet valve 14 to the seated position.

As best shown in FIG. 2, the self-locking means 24 includes three equally spaced narrow slots 32 extending radially outwardly from the bore 26 to an exterior surface 34 of the retainer means 22. The slots 32 extend the complete radial distance from the bore 26 to the exterior surface 34 for allowing the ledge 30 of the self-locking means 24 to deflect radially outwardly to at least the diameter of the bore 26 during installation. As best shown in FIG. 2, the three slots 32 create three flexible fingers 36 from the portion of the retainer means 22 between adjacent slots 32. The three fingers 36, thus, deflect radially outwardly as the retainer means 22 is moved to the operational position on the stem 18, which allows the ledge 30 of the self-locking means 24 to deflect, or expand, to a diameter at least as large as that of the bore 26 before snapping into the locked operational position under the ledge 28. As will be readily appreciated by those skilled in the art, more or less than three slots 32 and fingers 36 may be provided without departing from the self-locking concept.

The retainer means 22 includes an upper end 38 and a lower end 40. As shown in FIG. 2, the three slots 32 extend axially of the bore 26 through the upper end 38 to a termination 42 adjacent to, yet spaced from, the lower end 40. The termination 42 of each of the slots 32 is spaced from the lower end 40 a sufficient distance to prevent breakage and also for other reasons to be addressed subsequently.

An annular flange 44 extends radially outwardly from the upper end 38 of the retainer means 22 and presents an annular face 46 toward the lower end 40. The flange 44 is generally disk-shaped having a beveled peripheral edge 47. As shown in FIGS. 2 and 3, the peripheral edge 47 extends frustoconically from the flat top surface of the flange 44 and then straight and axially to the annular face 46, thus presenting a smooth and easily handled beveled peripheral edge 47.

The exterior surface 34 of the retainer means 22 has an inwardly tapering generally frustoconical shape extending from adjacent the flange 44 to the lower end 40. In other words, the exterior surface 34 tapers conically inwardly from the annular face 46 of the flange 44 to the lower end 40. As best shown in FIG. 3, the interface between the annular face 46 and the frustoconical exterior surface 34 is angled for engaging the coils of the return spring 20 and urging the self-locking means 24 more tightly into the locked operational position on the stem 18. That is, as the spring 20 pushes upwardly on the annular face 46 of the flange 44, the angled interface has the effect of squeezing the three fingers 36 into the stem 18 to constrict the retainer means 22 onto the seem 18 and better perfect the locked operational position to resist disconnection during operation of the engine 10. More particularly, as the poppet valve 14 is actuated and the return spring 20 is compressed, the increased forces placed upon the angled interface constrict the self-locking means 24 even more tightly about the stem 18 so that during high performance operation of the engine 10, the retainer mean 22 will continue to retain the return spring 20 on the poppet valve 14.

As shown in FIG. 3, the self-locking means 24 includes a frustoconical ramp 48 extending radially inwardly from the bore 26. The ramp 48 is a relatively long surface tapering inwardly from the bore 26 to the innermost edge of the ledge 30. The stem 18 also includes a frustoconical groove 50 which perfectly compliments the ramp 48 so that the ramp 48 and the groove 50 are contiguous when the retainer means 22 is disposed in the operational position on the poppet valve 14. The ramp 48 of the self-locking means 24 facilitates the installation of the retainer means 22 onto the stem 18 of the poppet vale 14 in that as the stem 18 is inserted into the bore 26 in the retainer means 22 and moved axially toward the operational position, the ramp 48 pushes the three fingers 36 radially outwardly so that the ledge 30 of the self-locking means 24 may pass around the stem 18 and subsequently automatically snap underneath the recessed surface 28 upon reaching the operational position. As will be understood, the ramp 48 is in reality divided into three portions due to the three slots 32 extending therethrough.

The retainer means 22 includes an integral oil seal portion 52 adjacent the lower end 40 for sealing against oil leakage between the bore 26 and the stem 18, as shown in FIG. 3. More specifically, the oil seal portion 52 extends from the ramp 48 straight to the lower end 40 and is adapted to tightly engage about the complimentary shaped portion of the stem 18. Because the oil seal portion 52 is integral with the entire retainer means 22, the requirement of a separate sealing ring, as taught in the prior art, is negated.

As also shown in FIG. 3, the subject retainer means 22 may include an integral drip shield 54 depending from the lower end 40. The drip shield 54 is a cylindrical sleeve-like member adapted to divert oil from dripping onto the valve guide 19. During operation of the engine 10, circulated oil drips about the exterior of the retainer means 22. The drip shield 54 prevents this oil from draining down the stem 18 and directly onto the valve guide 19. Preferably, the drip shield 54 is adapted for telescopic movement about the valve guide 19, and thereby constantly surrounds the valve guide 19 during operation.

A metallic washer 56 may also be provided adjacent the annular face 46 to prevent degradation of the surface due to wear, as shown in FIG. 3. The washer 56 is parallel to the angled interface between the annular face 46 and the frustoconical exterior surface 34. The washer 56 may be either a continuous annular member bridging each of the slots 32, or may be a sectional member having three arcuate extensions corresponding to the individual fingers 36. Preferably, the washer 56 is fabricated from a stainless steel material for corrosion and wear resistance.

As previously stated, the subject retainer means 22 is an integral, or one-piece, member. Preferably, the retainer means 22 is fabricated from a homogeneous organic polymeric material, such as Dupont Delron 500. In this manner, the subject retainer means 22 is light weight and inexpensive. Alternatively, the organic polymeric material may be mixed with glass fibers for increased strength. Also, boron or carbon reinforcing fibers may be added to the plastic material for substantially increased strength. Further, a solid metallic insert may be provided in any of the above material combinations for even greater strength capabilities. These strength and weight advantages coupled with the extreme ease and quickness of installation, as well as the lack of special installation tools required to lock the retainer means 22 onto the stem 18 of the poppet valve 14, make the subject retainer means 22 much more desirable than the prior art spring retainers. Of course, other materials and means may be used instead of the above examples without departing from the spirit of the subject invention.

As shown in FIG. 1, the engine 10 is of the typical internal combustion type wherein the combustion chamber 13 is disposed in an engine block 58. The cylinder head !5 caps the block 58 and supports the network of poppet valves 14. Intake 60 and exhaust 62 manifolds communicate with specially adapted ports in the cylinder head 15 to convey fresh and burnt fuel, respectively, to the combustion chambers 13 via the poppet valves 14. A rocker cover 64 is disposed over the cylinder head 15 for protecting an array of rocker arms 66. One rocker arm 66 is associated with each poppet valve 14 for urging the poppet valve 14 away from the valve seat 16 to an actuated position. An oil pan 68 is disposed below the block 58 for storing a supply of circulating engine oil. A crank pulley 70 is driven by the crankshaft. A V-belt 72 is disposed about the crank pulley 70 and actuates a water pump pulley 74.

Installation of the retaining means 22 upon the poppet valve 14 will be addressed presently. The poppet valve 14 is first positioned in the engine 10 and extended through the valve guide 19. The retainer spring 20 is next concentrically positioned about the stem 18 while the poppet valve 14 is supported in the seated position against the valve seat 16. The subject retainer means 22 is then axially inserted onto the stem 18. As the distall end of the stem 18 moves through the bore 26, it engages the ramp 48 of the self-locking means 24 to push the three fingers 36 radially outwardly. As the retainer means 22 approaches the operational position, the ledge 38 moves toward and then automatically snaps underneath the recessed surface 28 of the stem 18. With this, the self-locking means 24 is engaged in the groove 50 of the stem 18 and thus securely and permanently locked in the operational position. As will be appreciated, the retainer means 22 is simply and easily pushed onto the stem 18 and thereby automatically locks in place as the self-locking means 22 snaps under the recessed surface 28 of the stem 18.

If removal of the retainer means 22 from the stem 18 is desired, a special tool may be provided which separates the three slots 32 to move the three fingers 36 radially outwardly to a position where the ledge 30 of the self-locking means 24 may be moved past the recessed surface 28 of the stem 18.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An engine apparatus including a spring retainer (22) of the type for retaining a return spring (20) on a stem (18) of a poppet valve (14), said apparatus (10) comprising: a valve seat (16); a valve guide (19); a poppet valve (14) having a stem (18) slideably supported in said valve guide (19); a return spring (20) associated with said stem (18) for urging said poppet valve (14) in a predetermined direction against said valve seat (16); and one-piece retainer means (22) having an operational position on said stem (18) for retaining said return spring (20) on said poppet valve (14) and including a cylindrical bore (26) having a substantially uniform diameter surrounding said stem (18) when in said operational position, characterized by said retainer means (22) including integral self-locking means (24) for automatically locking said retainer means (22) on said stem (18) when said retainer means (22) is in said operational position, said self-locking means (24) extending radially inwardly from said bore (26).

2. An apparatus as set forth in claim 1 further characterized by said stem (18) including a recessed surface (28) facing in a direction away from said predetermined direction, and said self-locking means (24) including a ledge (30) extending radially upwardly from said bore (26) and facing in a direction toward said predetermined direction, said recessed surface (28) of said stem (18) and said ledge (30) of said self-locking means (24) means being contiguous when in said operational position for transferring forces between said retainer means (22) and said poppet valve (14).

3. An apparatus as set forth in claim 2 further characterized by said self-locking means (24) including at least one slot (32) extending outwardly from said bore (26) of said retainer means (22) to an exterior surface (34) thereof for allowing said ledge (30) to deflect radially outwardly to at least the diameter of said bore (26).

4. An apparatus as set forth in claim 3 wherein said retainer means (22) includes an upper end (38) and a lower end (40) spaced from said upper end (38) in a direction away from said predetermined direction, further characterized by said retainer means (22) including an annular flange (44) extending radially outwardly from adjacent said upper end (38).

5. An apparatus as set forth in claim 4 further characterized by said exterior surface (34) of said retainer means (22) having an inwardly tapering generally frustoconical shape from adjacent said flange (44) to said lower end (40).

6. An apparatus as set forth in claim 5 further characterized by said slot (32) extending axially of said bore (26) from said upper end (38) to a termination (42) adjacent said lower end (40).

7. An apparatus as set forth in claim 6 wherein said flange (44) presents an annular face (46) toward said lower end (40), further characterized by said annular face (46) including an angled annular interface adjacent said frustoconical exterior surface (34) for engaging said return spring (20) and urging said self-locking means (24) more tightly into said locked operational position.

8. An apparatus as set forth in claim 7 further characterized by said bore (26) including an integral oil seal portion (52) distal said ledge (30) of said self-locking means (24) for sealing against oil leakage between said bore (26) and said stem (18).

9. An apparatus as set forth in claim 8 further characterized by said self-looking means (24) including a frustoconical ramp (48) extending radially inwardly from adjacent said oil seal portion (52) to said ledge (30), and said stem (18) including a frustoconical groove (50) contiguous to said ramp (48) when said retainer means (22) is in said operational position.

10. An apparatus as set forth in claim 9 further characterized by said retainer means (22) including a tubular drip shield (54) depending straight and axially from said lower end (40).

11. An apparatus as set forth in claim 10 further characterized by said retainer means (22) including a washer (56) contiguous with said annular face (46) of said flange (44).

12. A poppet valve assembly of the type for regulating fuel flow in a combustion chamber (13) of an engine (10), said assembly comprising: a poppet valve (14) having a valve head (17) and an elongated stem (18) extending perpendicularly from said valve head (17); and one-piece retainer means (22) having an operational position on said stem (18) for retaining a return spring (20) on said poppet valve (14) and including a cylindrical bore (26) having a substantially uniform diameter surrounding said stem (18) when in said operational position, characterized by said retainer means (22) including integral self-locking means (24) for automatically locking said retainer means (22) on said stem (18) when said retainer means (22) is moved on said stem (18) to said operational position, said self-locking means (24) extending radially inwardly from said bore (26).

13. An assembly as set forth in claim 12 further characterized by said stem (18) including a recessed surface (28) facing in a direction away from said valve head (17), and said self-locking means (24) including a ledge (30) extending radially inwardly from said bore (26) and facing in a direction toward said valve head (17), said recessed surface (28) of said stem (18) and said ledge (30) of said self-locking means (24) means being contiguous when in said operational position.

14. An assembly as set forth in claim 13 further characterized by said self-locking means (24) including at least one slot (32) extending outwardly from said bore (26) of said retainer means (22) to an exterior surface (34) thereof for allowing said ledge (30) to deflect radially outwardly to at least said diameter of said bore (26).

15. An assembly as set forth in claim 14 wherein said retainer means (22) includes an upper end (38) and a lower end (40), further characterized by said retainer means (22) including an annular flange (44) extending radially outwardly from adjacent said upper end (38).

16. An assembly as set forth in claim 15 further characterized by said exterior surface (34) of said retainer means (22) having an inwardly tapering generally frustoconical shape from adjacent said flange (44) to said lower end (40).

17. An assembly as set forth in claim 16 further characterized by said slot (32) extending axially of said bore (26) from said upper end (38) to a termination (42) adjacent said lower end (40).

18. An assembly as set forth in claim 17 Wherein said flange (44) presents an annular face (46) toward said lower end (40), further characterized by said annular face (46) including an angled annular interface adjacent said frustoconical exterior surface (34) for engaging the return spring (20) and urging said self-locking means (24) more tightly into said locked operational position.

19. An assembly as set forth in claim 18 further characterized by said bore (26) including an integral oil seal portion (52) distal said ledge (30) of said self-locking means (24) for sealing against oil leakage between said bore (26) and said stem (18).

20. An assembly as set forth in claim 19 further characterized by said retainer means (22) including a tubular drip shield (54) depending straight and axially from said lower end (40).

21. An assembly as set forth in claim 20 further characterized by said retainer means (22) including a washer (56) contiguous with said annular face (46) of said flange (44).

* * * * *